US005980152A

United States Patent [19]

Rehberger

[11] Patent Number: 5,980,152

[45] Date of Patent: Nov. 9, 1999

[54] HIGHWAY COUPLING APPARATUS AND METHODS

[76] Inventor: Amos Rehberger, P.O. Box 148, Anna, Ill. 62906

[21] Appl. No.: 08/928,678

[22] Filed: Sep. 12, 1997

[51] Int. Cl.[6] ..... E01C 11/14

[52] U.S. Cl. ..... 404/60; 404/48; 404/63; 404/74; 14/73.1

[58] Field of Search ..... 404/47, 48, 56, 404/60, 61, 62, 63, 74; 14/73.1

[56] References Cited

U.S. PATENT DOCUMENTS

| | | | |
|---|---|---|---|
| 1,780,588 | 11/1930 | Heltzel | 404/56 |
| 2,079,123 | 5/1937 | Lind | 404/62 |
| 2,323,026 | 6/1943 | Geyer | 404/48 |
| 2,325,472 | 7/1943 | Brickman | 404/60 |
| 4,449,844 | 5/1984 | Larsen | 404/60 |
| 5,487,249 | 1/1996 | Shaw et al. | 404/60 |

FOREIGN PATENT DOCUMENTS

| | | | |
|---|---|---|---|
| 0678122 | 8/1979 | U.S.S.R. | 404/60 |

*Primary Examiner*—Thomas B. Will
*Assistant Examiner*—Kristine M. Markovich
*Attorney, Agent, or Firm*—Armstrong Teasdale LLP; Scott R. Hayden

[57] ABSTRACT

A highway coupling apparatus includes an expansion joint template, a plurality of rods, and a plurality of pipes. The template is positioned between longitudinal forms of a highway lane, creating two sections. After positioning the reinforcement bar in each section, the rods are extended through the expansion joint template and movably coupled to the pipes located in the second section. The highway coupling apparatus also includes a movement joint to couple adjacent lanes of the highway. The movement joint includes a plurality of eye bolts, L-bolts, movement joint templates, and a movement joint form. The eye bolts and L-bolts partially extend from the respective first and second lanes into the movement joint templates and are coupled. The movement joint templates are coupled to the movement joint form and prevent concrete from entering the eye bolt eyes during fabrication. After concrete is poured into the lanes and allowed to set, the expansion joint template and movement joint form are removed, resulting in an expansion groove and a movement joint groove. The grooves extend the entire depth of the highway and are filled with pitch to allow relative movement of the highway sections and lanes.

18 Claims, 2 Drawing Sheets

HIGHWAY COUPLING APPARATUS AND METHODS

FIELD OF THE INVENTION

This invention relates generally to highways and, more particularly, to methods and apparatus for joining adjacent highway sections.

BACKGROUND OF THE INVENTION

Under current practice in highway construction, twelve foot wide concrete lanes are poured in continuous lengths. Prior to pouring the concrete, forms are positioned to define the shape of the lane and metal reinforcement bars are placed within the forms. Reinforcement bars, or rebar, is placed on supports so that the rebar will be located at a depth of about the middle of the concrete. After the concrete has been poured and initially set, transverse cuts are made across the width of each lane at various intervals. The initial cut is about one inch wide and extends about one-half the depth of the concrete. The purpose of the cut is to weaken the concrete and cause the concrete to crack in the plane of the cut through the full depth of the concrete, thereby forming two abutting sections of highway. After the concrete is fully cured, the initial cut is then widened to about two inches, forming a groove. An expansion joint is then inserted in the groove. The expansion joint may be an extruded neoprene, pitch, or a semi-liquid material such as tar which is poured into the groove.

In multiple lane highways, additional lanes of highway are formed adjacent to the first lane. The additional lanes are formed in a manner similar to the first lane, however, the second lane is poured using the first lane as a longitudinal form. The lanes are formed without any coupling between the lanes so that each lane moves independent of the other lane. Shoulder lanes are formed adjacent to the outer lanes.

While the above described structure allows relatively minor elevation changes in the abutting sections of the highway, such structure does not readily accommodate expansion of the highway sections. While, the initial cut made in the highway creates two abutting sections of highway, the cut extends only one-half of the depth of the concrete, therefore the two sections cannot expand. Although the top half of one section of the highway is spaced away from another section, the lower half of each section remains fully against the other section. Therefore, each section may rise and fall relative to the other section but cannot expand without pushing against the other section. Any expansion of the highway sections causes the highway to buckle, or erupt, resulting in significant structural damage to the highway. Additionally, such method is labor intensive and time consuming. Particularly, each lane of the highway must be cut at least twice and the groove must be thoroughly cleaned to remove any foreign objects or materials before the expansion joint is inserted. In addition, as a result of cutting only one-half of the highway depth, it is possible that the highway will crack in a plane other than that of the cut resulting in substantial structural damage to the highway.

It would be desirable to provide a highway coupling apparatus which is easy to install that would couple sections of highway without requiring the cutting of the highway. It would further be desirable to provide such an apparatus that provides an expansion joint extending the fall depth of the highway. Additionally, it would be desirable to provide an apparatus which couples parallel highways sections while preventing separation of the highway sections.

SUMMARY OF THE INVENTION

These and other objects may be attained by a highway coupling apparatus which, in one embodiment, couples sections and lanes of a highway, while allowing relative movement of the highway. The highway coupling apparatus includes a plurality of cylindrical shaped rods that extend between the first and second sections of the highway and a plurality of cylindrical pipes. Each pipe has an axial bore sized to receive a portion of each rod. The rods are slidably coupled to the pipes therefore maintaining the coupling between the highway sections while allowing expansion of the sections. The highway coupling apparatus further includes a substantially elongate expansion joint template having a plurality of slots and removal fingers. The expansion joint template is sized to be the same width and height as each lane of the highway and is positioned between the first and second sections of the highway over the rods. Because the expansion joint template is removed after the concrete has been poured, the expansion joint template determines the spacing between the first and second sections of the highway. The spacing, or expansion groove, allows the first and second sections to expand prior to abutting the other section.

The highway coupling apparatus also includes a movement joint for coupling adjacent lanes of a highway. The movement joint includes a substantially elongate movement joint form having a plurality of slots extending from the bottom of the form. The form is sized to be the same height as the highway and act as a longitudinal form between the first and second lanes. The movement joint further includes a plurality of eye bolts partially extending from the first lane of the highway and a plurality of L shaped L-bolts. The L-bolts partially extend from the second lane of the highway and couple to the eye bolts. In addition, the movement joint includes a plurality of movement joint templates, each being substantially cylindrical shaped and closed at one end. Each template includes an opening sized to receive an eye bolt and an opening sized to receive a L-bolt. The templates prevent concrete from entering the eye bolt eyes during fabrication of the highway and remain embedded in the highway.

In fabricating a highway, a highway coupling apparatus is inserted between adjacent sections and adjacent lanes of the highway. Particularly, forms are placed at the appropriate length and width of the first lane. After positioning and securing the expansion joint template perpendicular to the longitudinal forms, creating the first and second sections, reinforcement bars, or rebar, is secured in the first and second sections. A similar process is completed for the second lane first and second sections. Apparatus rods are extended through the expansion joint template slots and coupled to the first section rebar. The pipes are placed over the first ends of the rods and coupled to the second section rebar. Prior to pouring the concrete, eye bolts and L-bolts are coupled and extended through the movement joint templates. The movement joint templates are then coupled to the movement joint form openings. The eye bolts are then coupled to the first section rebar and the L-bolts are coupled to the second lane rebar. The movement joint templates prevent concrete from covering the exposed portion of the eye and L-bolts. Concrete is then poured into the first and second lane forms thereby embedding rebar, rods, pipes, the expansion joint template, the movement joint form, movement joint templates, eye bolts, and L-bolts.

After the concrete in both lanes has set, the expansion joint template and the movement joint form are removed. The removal of the expansion template creates an expansion groove allowing thermal expansion of the two sections of the first lane. The expansion groove is filled with pitch, tar, or similar material to prevent foreign material from entering the groove while allowing the sections to expand and contract. Following removal of the movement joint form, resulting in a lateral groove, the groove is filled with a material similar to the material used to fill the first groove.

It would be desirable to provide a highway coupling apparatus which is easy to install that would couple sections of highway without requiring the cutting of the highway. It would further be desirable to provide such an apparatus that provides an expansion joint extending the full depth of the highway. Additionally, it would be desirable to provide an apparatus which couples parallel highways sections while preventing separation of the highway sections.

DETAILED DESCRIPTION

Figure 1:
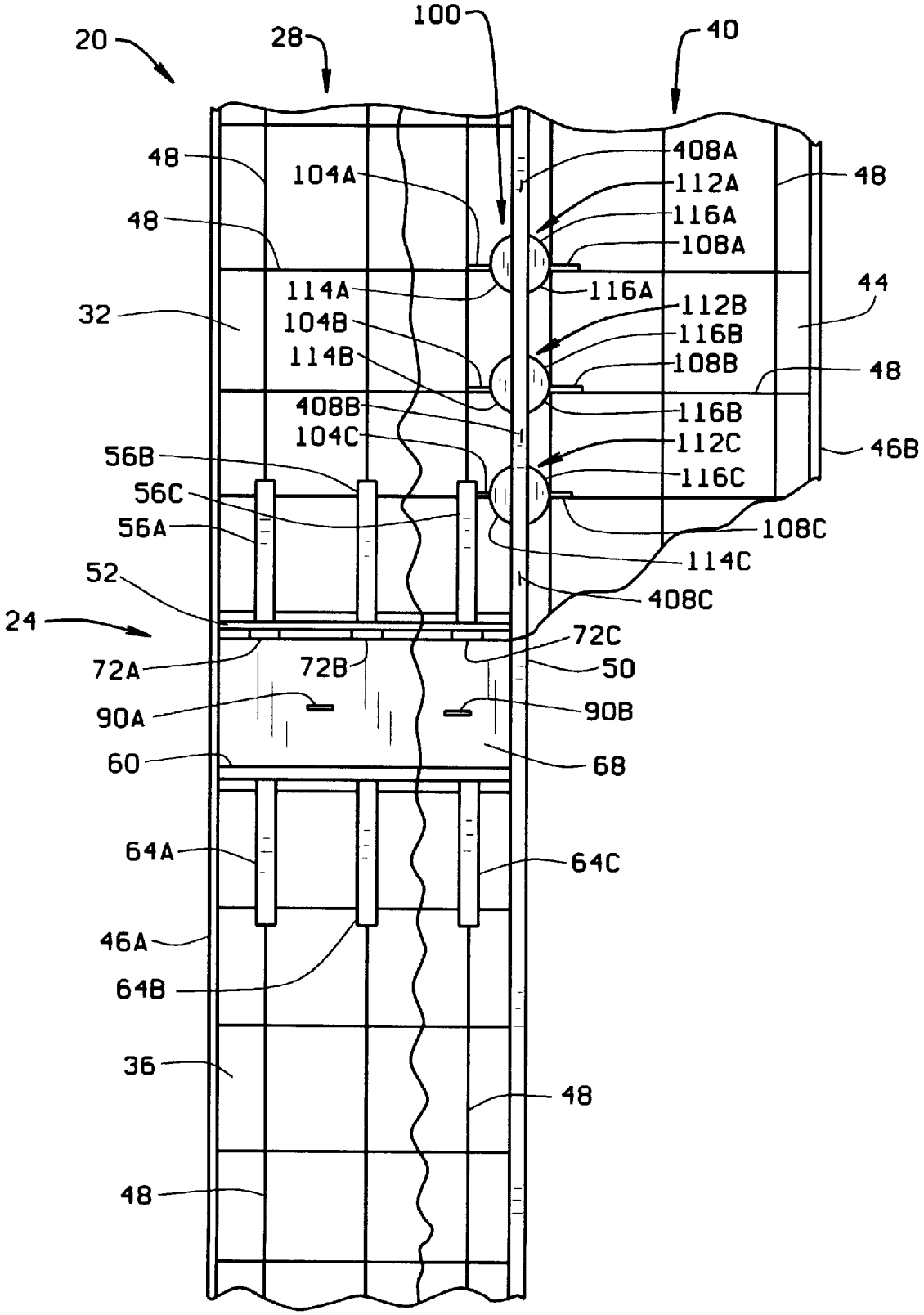
FIG. 1 is a top view of a highway including a highway coupling apparatus.

FIG. 1 is a top view of a highway 20 and a highway coupling apparatus 24. Highway 20 includes a first lane 28 having a first section 32 and a second section 36, and a second lane 40 having a first section 44 and a second section (not shown). Highway coupling apparatus 24 includes movement joint form 50, a substantially elongate first coupling member 52, a plurality of cylindrical rods 56A, 56B, and 56C, a substantially elongate second coupling member 60, a plurality of substantially cylindrical pipes 64A, 64B, and 64C, and a substantially elongate expansion joint template 68. Movement joint form 50 is a substantially elongate member sized to be the same height as highway 20. Form 50 replaces one of the standard longitudinal forms in multiple lane highway fabrication. First coupling member 52 is sized to be approximately the same width and height as lane 28 or 40 and includes a plurality of circular shaped openings (not shown in FIG. 1) sized to receive rods 56A, 56B, and 56C. First coupling member 52 is fabricated from a thin flexible material, for example, plastic. Rods 56A, 56B, and 56C each include a respective stop flange 72A, 72B, and 72C and a respective rod sleeve 76A, 76B, and 76C. Rods 56A, 56B, and 56C are typically made of steel and are sized to slidably extend into pipes 64A, 64B, and 64C. Stop flanges 72A, 72B, and 72C are integral, or welded, to rods 56A, 56B, and 56C. Second coupling member 60 is sized to be approximately the same width and height as lane 28 or 40 and includes a plurality of circular shaped openings (not shown in FIG. 1) to receive pipes 64A, 64B, and 64C. Second coupling member 60 is fabricated from a thin flexible material, for example, plastic. Pipes 64A, 64B, and 64C each contain a bore (not shown) sized to receive a portion of respective rods 56A, 56B, and 56C. Expansion joint template 68 is the same width and height as lane 28 or 40. Expansion joint template 68 is sized to be placed between first and second coupling members 52 and 60 and to be removed after highway 20 is fabricated to create an expansion groove (not shown) of adequate thickness to allow highway 20 to expand. Expansion joint template 68 is made from a durable material allowing reuse, such as steel. Expansion joint template 68 includes removal fingers 90A and 90B providing a lifting mechanism for removing expansion joint template 68 after concrete has set.

Highway coupling apparatus 24 further includes a movement joint 100 for coupling first lane 28 and second lane 40. Movement joint 100 includes a plurality of eye bolts 104A, 104B, and 104C, a plurality of L-bolts 108A, 108B, and 108C, and a plurality of movement joint templates 112A, 112B, and 112C. Eye bolts 104A, 104B, and 104C are sized to receive a portion of respective L-bolts 108A, 108B, and 108C and be embedded in first section 32. L-bolts 108A, 108B, and 108C are sized to extend from first section 44 of the second lane 40 and be coupled to eye bolts 104A, 104B, and 104C. Movement joint templates 112A, 112B, and 112C are substantially cylindrical shaped and are closed at one end. Movement joint templates 112A, 112B, and 112C are sized to be approximately two-thirds of the height of highway 20. Movement joint templates 112A, 112B, and 112C include a respective first portion 114A, 114B, and 114C and a respective second portion 116A, 116B, and 116C.

Figure 2:
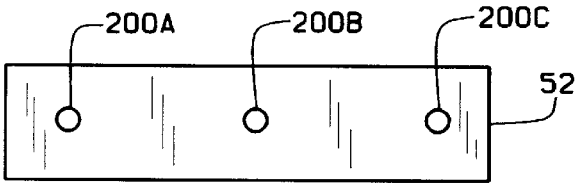
FIG. 2 is a side view of a highway coupling apparatus first coupling member.
Figure 3:
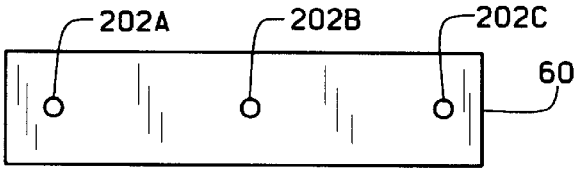
FIG. 3 is a side view of a highway coupling apparatus second coupling member.

Referring to FIGS. 2 and 3, first coupling member 52 includes a plurality of openings 200A, 200B, and 200C sized so that rods 56A, 56B, and 56C are positioned about in the center of highway 20 depth and to prevent concrete from flowing into the expansion joint groove. Second coupling member 60 includes a plurality of openings 202A, 202B, and 202C sized so that pipes 64A, 64B, and 64C will be aligned with rods 56A, 56B, and 56C and to prevent concrete from flowing into the expansion joint groove.

Figure 4:
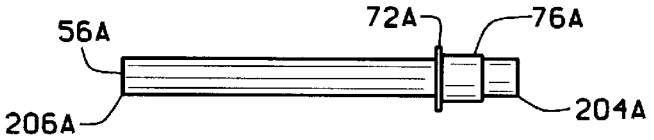
FIG. 4 is a side view of a highway coupling apparatus rod.

FIG. 4 is a side view of 56A which is identical to rods 56A, 56B, and 56C. Rods 56A, 56B, and 56C include respective first ends 204A, 204B, and 204C, respective second ends 206A, 206B, and 206C, and respective rod sleeves 76A, 76B, and 76C. Rod sleeve 76A, 76B, and 76C are sized to maintain the proper spacing between the respective first ends of pipes 64A, 64B, and 64C and stop flanges 72A, 72B, and 72C during installation. Rod sleeves 76A, 76B, and 76C are positioned between stop flanges 72A, 72B, and 72C and respective rod first ends 204A, 204B, and 204C and made from a organic material, for example, plastic, that will compress when sufficient compression forces are applied by concrete sections 32 and 36.

Figure 5:
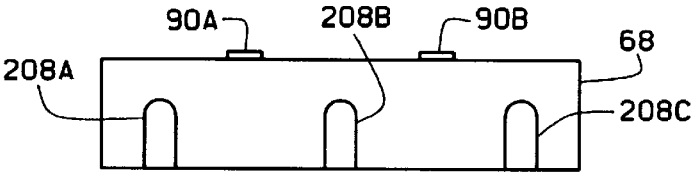
FIG. 5 is a highway coupling apparatus expansion joint template.

FIG. 5 is a side view of expansion joint template 68 having a plurality of slots 208A, 208B, and 208C sized to be placed over rods 56A, 56B, and 56C extending between first section 32 and second section 36. Slots 208A, 208B, and 208C are sized so that stop flanges 72A, 72B, and 72C are unable to pass through slots 208A, 208B, and 208C.

Figure 6:
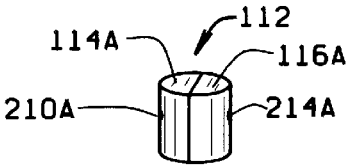
FIG. 6 is a side view of a highway coupling apparatus movement joint template.

FIG. 6 is a side view of movement joint template 112A which is identical to templates 112B and 112C. Movement joint template first portions 114A, 114B, and 114C include respective openings 210A, 210B, and 210C sized to receive a portion of respective eye bolts 104A, 104B, and 104C. Movement joint template second portions 116A, 116B, and 116C each include an opening 214A, 214B, and 214C sized to receive a portion of respective L-bolts 108A, 108B, and 108C.

Figure 7:
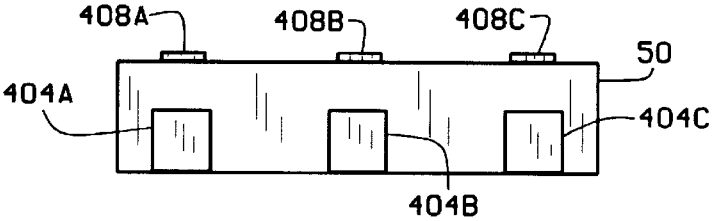
FIG. 7 is a side view of a highway coupling apparatus movement joint form.

FIG. 7 is a side view of a movement joint form 50. Form 50 includes a plurality of slots 404A, 404B, and 404C and a plurality of removal fingers 408A, 408B, 408C. Form 50 is made from a durable material allowing reuse, such as steel. Slots 404A, 404B, and 404C are sized to receive movement joint templates 112A, 112B, and 112C. Fingers 408A, 408B, and 408C are sized to provide a lifting mechanism for removing movement joint form 50 after highway 20 has been fabricated.

In fabricating highway 20, highway coupling apparatus 24 is inserted between adjacent sections 32 and 36 and adjacent lanes 28 and 40. Particularly, longitudinal form 46A and movement joint form 50 are placed at the desired width of first lane 28, with form 50 being placed between first and second lanes 28 and 40. At the appropriate length, depending on, for example, the fabrication material and the specific climate, expansion joint template 68 is positioned perpendicular to forms 46A and 50, thereby creating first and second sections 32 and 36. Rebar 48 is then placed in first and second sections 32 and 36 so that rebar 48 is placed about in the center of highway 20 depth. After securing rebar 48, rod first ends 204A, 204B, and 204C are extended through expansion joint template slots 208A, 208B, and 208C until stop flanges 72A, 72B, and 72C are adjacent to expansion joint template 68 thereby extending rod first ends 204A, 204B, and 204C into second section 36. First coupling member openings 200A, 200B, and 200C are placed over rod second ends 206A, 206B, and 206C until first coupling member 52 is adjacent to stop flanges 72A, 72B, and 72C thereby clamping stop flanges 72A, 72B, and 72C between first coupling member 52 and expansion joint template 68. Then, rods 56A, 56B, and 56C are secured to first section rebar 48. Second coupling member openings 208A, 208B, and 208C are placed over rod first ends 204A, 204B, and 204C extending into second section 36. Second coupling member 60 is then positioned adjacent to expansion joint template 68. Pipe first ends 208A, 208B, and 208C are placed over rod first ends 204A, 204B, and 204C until adjacent to rod sleeves 76A, 76B, and 76C. Pipes 64A, 64B, and 64C are then coupled to second section rebar 48.

In multiple lane highways, movement joint 100 is utilized to couple first and second lanes 28 and 40. Particularly, longitudinal form 46B is spaced from form 50 the width of second lane 40 and secured. Thereafter, movement joint template first portions 114A, 114B, and 114C are placed in first lane 28 and movement joint template second portions 116A, 116B, and 116C are placed in second lane 40. First portions 114A, 114B, and 114C are placed adjacent to movement form openings 404A, 404B, and 404C and coupled in position. Eye bolts 104A, 104B, and 104C are then extended though first portion openings 210A, 210B, and 210C into first section 32. L-bolts 108A, 108B, and 108C are coupled to eye bolts 104A, 104B, and 104C in an alternating fashion of extending L-bolt 108A upward through eye of eye bolt 104A, then extending downward through eye of eye bolt 104B so that lanes 28 and 40 will not separate as a result of elevation changes of either lane 28 or 40. After coupling L-bolts 108A, 108B, and 108C to eye bolts 104A, 104B, and 104C, L-bolts 108A, 108B, and 108C are extended through second portion openings 214A, 214B, and 214C into second lane 40. Second portions 116A, 116B, and 116C are then placed adjacent to movement form 50 and coupled in position. Eye-bolts 104A, 104B, and 104C and L-bolts 108A, 108B, and 108C are then coupled to rebar 48.

Thereafter, concrete is poured into first and second lanes 28 and 40 thereby embedding rebar 48 and highway coupling apparatus 24. After the concrete has set, expansion joint template 68 and movement joint form 50 are then removed using respective fingers 90A and 90B, and 408A, 408B, and 408C. The removal of template 68 creates the expansion groove allowing sections 32 and 36 to expand as a result of thermal expansion. The expansion groove thereafter is filled with pitch, tar, or a similar material (not shown) thereby preventing foreign materials from entering the expansion groove while allowing sections 32 and 36 to expand. Removal of movement joint form 50 creates a longitudinal groove (not shown) which is filled with a material similar to expansion groove. The longitudinal groove allows first and second lanes 28 and 40 to move relative to each other while preventing separation.

During periods of thermal expansion, for example, first section 32 is allowed to expand in length by an amount equal to the width of the expansion groove prior to abutting second section 36. Particularly, as first section 32 expands, rod first ends 204A, 204B, and 204C extend further into respective pipes 64A, 64B, and 64C. During such time, the material inserted into the expansion groove is compressed or forced out thereby allowing first section 32 to freely expand without pushing against section 36, therefore avoiding damage to first and second sections 32 and 36. Additionally, the properties of the material allow the material to be subjected to such compression without sustaining damage and when sections 32 contracts to its original length, the material expands and fills the expansion groove. In addition, highway coupling apparatus 24 coupling allows adjacent lanes 28 and 40 to move relative to each other while maintaining a lateral groove between lanes 28 and 40. The movement joint reduces the fictional forces applied between lanes 28 and 40.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention is to be limited only by the terms of the appended claims.

I claim:

1. A highway coupling apparatus for coupling sections of a highway, the highway including at least a first lane having a first section and a second section, said apparatus comprising:

a plurality of cylindrical rods configured to extend between the first and second sections and be embedded in the highway, each said cylindrical rod comprises a stop flange;

a plurality of cylindrical pipes configured to be embedded in the second section and receive a portion of said rods; and an expansion joint template having a plurality of slots, said template configured to be placed between the first and second sections of the highway and over a portion of said rods.

2. A highway coupling apparatus in accordance with claim 1 wherein each rod comprises a rod sleeve positioned between said stop flange and said rod first end.

3. A highway coupling apparatus in accordance with claim 1 further comprising a first coupling member having a plurality of openings and configured to be embedded in the highway.

4. A highway coupling apparatus in accordance with claim 3 wherein said openings are configured to receive said rods.

5. A highway coupling apparatus in accordance with claim 3 further comprising a second coupling member having a plurality of openings and configured to be embedded in the highway.

6. A highway coupling apparatus in accordance with claim 5 wherein said openings are configured to receive said pipes.

7. A highway coupling apparatus in accordance with claim 1 wherein the highway further comprises a second lane adjacent to the first lane having a first section and a second section, and wherein said apparatus further comprises a movement joint configured to couple the first and second lanes of the highway.

8. A highway coupling apparatus in accordance with claim 7 wherein said movement joint comprises a plurality of eye bolts configured to be embedded in the first lane and a plurality of L-bolts configured to couple to said eye bolts and be embedded in the second lane.

9. A highway coupling apparatus in accordance with claim 8 wherein said movement joint further comprises a movement joint template configured to receive a portion of said eye and L-bolts.

10. A method of coupling sections of a highway utilizing a highway coupling apparatus, the highway including at least a first lane having a first section and a second section, and the highway coupling apparatus having a plurality of rods, a plurality of pipes, and an expansion joint template including a plurality of slots, each rod including a first end, a second end, and a stop flange, said method comprising the steps of:

inserting the expansion joint template between the first and second sections;

positioning the rods in the first section so that the stop flange is adjacent to the expansion joint template;

positioning the pipes in the second section;

extending the pipes over the rods;

embedding the highway coupling apparatus; and removing the expansion joint template.

11. A method in accordance with claim 10 wherein positioning the rods in the first section comprises the step of extending the rod first ends through the expansion joint template slots into the second section.

12. A method in accordance with claim 11 wherein the highway coupling apparatus further comprises a first coupling member having a plurality of openings, and wherein positioning the rods comprises the step of placing the first coupling member openings over the rod seconds ends until the first coupling member is adjacent to the stop flange.

13. A method in accordance with claim 12 wherein the highway further comprises first section reinforcement bars, and wherein positioning the rods further comprises the step of coupling the rods to the reinforcement bars.

14. A method in accordance with claim 10 wherein the highway coupling apparatus further comprises a second coupling member having a plurality of openings, and wherein positioning the pipes in the second section comprises the step of placing the second coupling member over the rod first ends until the second coupling member is adjacent to the expansion joint template.

15. A method in accordance with claim 10 wherein the highway coupling apparatus rods each include a rod sleeve, and wherein extending the pipes over the rods comprises the step of extending each pipe over each rod first end until each pipe is adjacent to each rod sleeve.

16. A method in accordance with claim 10 wherein the highway coupling apparatus further comprises a movement joint and the highway includes a second lane having a first section and a second section placed adjacent to the first lane, and wherein said method further comprises the step of positioning the movement joint between the first and second lanes prior to embedding the highway coupling apparatus.

17. A method in accordance with claim 16 wherein the movement joint includes a plurality of eye bolts, a plurality of L-bolts, and a movement joint form having a plurality of slots, and wherein positioning the movement joint between the first and second lanes comprises the steps of positioning the eye bolts in the first lane, positioning the L-bolts in the second lane, and coupling the L-bolts to the eye bolts.

18. A method in accordance with claim 17 wherein the movement joint further includes a plurality of movement joint templates having a first portion and a second portion, and wherein positioning the movement joint between the first and second lanes comprises the steps of coupling the movement joint template first portions in the first lane adjacent to the movement joint form slots, and coupling the movement joint template second portions in the second lane adjacent to the movement joint form openings.

* * * * *